United States Patent [19]

Kibby

[11] 4,334,917

[45] Jun. 15, 1982

[54] CARBOTHERMIC REDUCTION FURNACE

[75] Inventor: Robert M. Kibby, Richmond, Va.

[73] Assignee: Reynolds Metals Company, Richmond, Va.

[21] Appl. No.: 140,842

[22] Filed: Apr. 16, 1980

[51] Int. Cl.[3] ..... C22B 21/02

[52] U.S. Cl. ..... 75/10 R; 75/68 A

[58] Field of Search ..... 75/10 R, 68 RA; 13/23

[56] References Cited

U.S. PATENT DOCUMENTS

| | | | |
|---|---|---|---|
| 1,739,343 | 12/1929 | Baily | 13/23 |
| 3,723,093 | 3/1973 | Shiba et al. | 75/10 R |
| 4,146,389 | 3/1979 | Karlovitz | 75/10 R |
| 4,245,822 | 1/1981 | Dewing | 266/171 |

*Primary Examiner*—M. J. Andrews

*Attorney, Agent, or Firm*—Lyne, Girard & McDonald

[57] ABSTRACT

A carbothermic reduction process is described for producing alumina metal containing about 10% $Al_4C_3$. The process heats a descending charge by radiation at a rate of heat flux of 10–100 KW/sq. inch, to form a melt surface that is spaced from an open arc between a pair of electrodes. Additional alumina beyond the stoichiometric amount is preferably introduced into the reduction zone immediately surrounding the melt surface.

A large moving-bed shaft furnace is utilized. This furnace comprises hearth shoulders and preferably also comprises alumina introduction ports and a charge shaping device that cooperatively interacts with the hearth shoulders to suspend the descending charge column above a pool of melted aluminum product therebeneath, whereby the aluminum product is able to flow and/or fall into the pool with minimum passage over unreacted charge.

20 Claims, 2 Drawing Figures

CO
CO
FUME SEPARATION
20
21
CHARGE PREPARATION
COKE
PITCH
POWER PLANT
KW
CHARGE HEATING
ZONE A PRE REDUCTION
26
ALUMINA
KW
24
25
22
23
37
23
ZONE B
ALUMINA
31
35
31
ZONE D DECARBONIZATION
34
REDUCTION
32
29
ZONE C
37
36
19
38
39
27
AL+
AL
METAL
~10%
SLAG
Al4C3
30
28
29
DROSS
33

CARBOTHERMIC REDUCTION FURNACE

BACKGROUND OF THE INVENTION

1. Field of the Invention

This invention relates to the carbothermic production of aluminum from aliminum oxide in a carbon-containing material. It particularly relates to apparatuses including a reduction furnace wherein alumina and carbon are reacted by a carbothermic process to produce aluminum contaminated with 5–15% aluminum carbide.

2. Description of the Prior Art

Many attempts have been made to produce aluminum by a carbothermic process to replace the universally used electrolytic process. A carbothermic process has many potential advantages which are becoming increasingly important as energy costs continue to increase.

All of these efforts have failed because they have invariably produced a mixture of aluminum metal and aluminum carbide. When such a mixture of 10–20% carbide or more cools to about 1400° C., the aluminum carbide forms a cellular structure that entraps liquid aluminum; thus the mixture becomes difficult to pour. In consequence, unless extremely high temperatures are maintained throughout all of the steps, process manipulations of the mixture, in order to purify it, become extremely difficult if not impossible.

U.S. Pat. No. 2,974,032 and U.S. Pat. No. 2,828,961 have described results that are typical of those to be expected from carbothermic reduction of a stoichiometric charge of alumina and carbon in a conventional electrically heated smelting furnace. The metal produced from the former process contains 21–37% $Al_4C_3$; the metal produced by the latter process contains 20% $Al_4C_3$. These processes are limited because reactive carbon and/or aluminum carbide is always present in contact with the metal that is produced and because time is available for the metal to react with the carbon and then to dissolve carbide up to its solubility limit.

U.S. Pat. No. 3,929,456 and U.S. Pat. No. 4,033,757 disclose methods for carbothermically producing aluminum containing less than 20% $Al_4C_3$, i.e., 5–10%, which comprise striking an open arc intermittently to a portion of the surface of the charge to be reduced.

However, advances have now been made in the art, wherein aluminum that is contaminated with about 20% aluminum carbide can be treated so as to obtain aluminum of commercial purity. One such technique is described in co-pending application Ser. No. 7,986 now U.S. Pat. No. 4,216,010. This technique is adaptable to the production of aluminum containing less than 20% $Al_4C_3$ (i.e., 10%). It comprises the step of contacting a product containing from 20–35% $Al_4C_3$ with a melt rich in alumina in the absence of reactive carbon. Such purification techniques can impart commercial vitality to older carbothermic processes producing heavily contaminated aluminum. Thus it becomes worthwhile to locate the best existing prior art and to improve the effectiveness thereof.

In view of rapidly rising energy costs and regardless of the method that is employed to produce aluminum containing less than 20% $Al_4C_3$, it is clear that measures must be taken to limit the energy lost to vaporized products, as one such improvement. Energy lost to vaporization depends on the amount of vapor produced in the reduction and decarbonization steps and also depends on the amount of vapor that is recovered in back reactions which release heat at times and places within the system where that heat released can be employed in pre-reduction reactions.

The methods of U.S. Pat. No. 2,829,961 and U.S. Pat. No. 2,974,032 involve conditions where vapor production is minimized but only with respect to 35–45% of the aluminum values entering the reduction zone; they do not solve the vapor recapture problem. The method of U.S. Pat. No. 4,033,757 teaches that about 20% of the aluminum is vaporized to produce a vapor having a composition of about 50 mole percent aluminum and 50 mole percent $Al_2O$. It further teaches that a portion of the aluminum is condensed directly on a surface of the charge and a portion reacts with CO to form $Al_2OC$ which then reacts with more CO to form $Al_4O_4C$, and this further reacts with aluminum carbide in the charge to produce aluminum liquid which flows to the hearth pool over unreacted charge. However, the disclosure points out that the capacity of the charge column to absorb heat from the back reactions of the vaporization products is not unlimited, and when vapor product exceeds the capacity of the charge column to absorb heat, it becomes impossible to keep the heated reaction zone down below the electrode system where it belongs. The result of this situation is that unreacted vapors break through the surface of the charge column and cause what are known as "blow holes".

Supplying power economically requires that AC power be delivered through electrodes at high voltage and low currents. Such high voltages are obtained when electrical current flows via open arc between electrodes and the charge to be reduced for producing aluminum. However, it has been found that such open arcs cause excessive vapor production, including vaporized aluminum.

It is also known that high voltage AC heating is possible with electrodes which are submerged in and are conducting through the charge to be reduced. However, such a heating arrangement prevents the formation of an aluminum product containing less than 20% carbide when the metal product is held in contact with the semi-reduced charge layer through which the heating current is conducted to a hearth.

There is accordingly a need for a carbothermic reduction process wherein vapor production is minimized, AC current is used, control is simplified, and the metal product is quickly removed from contact with reactive carbon.

SUMMARY OF THE INVENTION

It is accordingly an object of this invention to provide an apparatus and method for producing aluminum containing $Al_4C_3$ in the range of 5–20% and preferably 9–12%.

It is another object to utilize this process without relying on intermittent arc application to the charge to be reduced.

It is also an object to operate the process without relying on contact of the aluminum product with an alumina-rich slag.

It is additionally an object to provide a hearth means for separating a downwardly moving charge column from a metal pool therebeneath, whereby metal can flow and/or fall from a melt surface as soon as it is formed while having minimum contact with unreacted charge.

It is further an object to operate the process under conditions wherein vapor production is limited to the amount that is characteristic of equilibrium reduction conditions.

It is finally an object to operate the process with high voltage-low current power supplies.

The carbothermic reduction furnace of this invention comprises means to recover fuel values from the CO produced as a reduction product while minimizing the production of aluminum-containing vapors from the reduction zone. This furnace is a moving-bed shaft furnace which is operable under pressure and contains a hearth means which separates a downwardly descending charge column from the metal product.

In a preferred mode, the receiving chamber is lined with non-carbonaceous material, thus minimizing the tendency of the metal product to become further contaminated with aluminum carbide. Preferably, the furnace also comprises a charge-shaping means which cooperatively interacts with the hearth means to suspend the descending charge and force it to move toward an open arc between electrodes. The furnace additionally comprises an alumina introduction means for feeding alumina into a reduction zone surrounding an open arc.

The charge-shaping means, in cooperation with the hearth means, causes the reduction product to fall into and mix with a layer of aluminum, containing aluminum carbide, which rests upon a slag layer accumulated when alumina in excess of stoichiometric requirements is charged directly to the reduction zone. The charge is not heated by transfer of electrical current to the charge; instead it is heated by thermal radiation from the open arc between one or more pairs of electrodes. The rate of heat flux to the melt surface of the charge by this thermal radiation is in the range of 10–100 KW/sq. inch. Stable reduction temperatures of about 2100° C. are created on a upstanding melt surface which is spaced from and surrounds the arc, thereby producing liquid aluminum metal which flows immediately away, over, and from the surface of the charge and over metal to reach a collection zone under conditions that minimize adsorption of carbon or aluminum carbide formation.

Such transfer of heat by thermal radiation from arcs between electrodes is provided by indirect arc heating, employing high voltage-low current arcs and even multiphase AC arcs without overheating the surface of the charge being reduced, whereby the production of vapors during reduction to produce aluminum is minimized.

DESCRIPTION OF THE PREFERRED EMBODIMENTS

Figure 1:
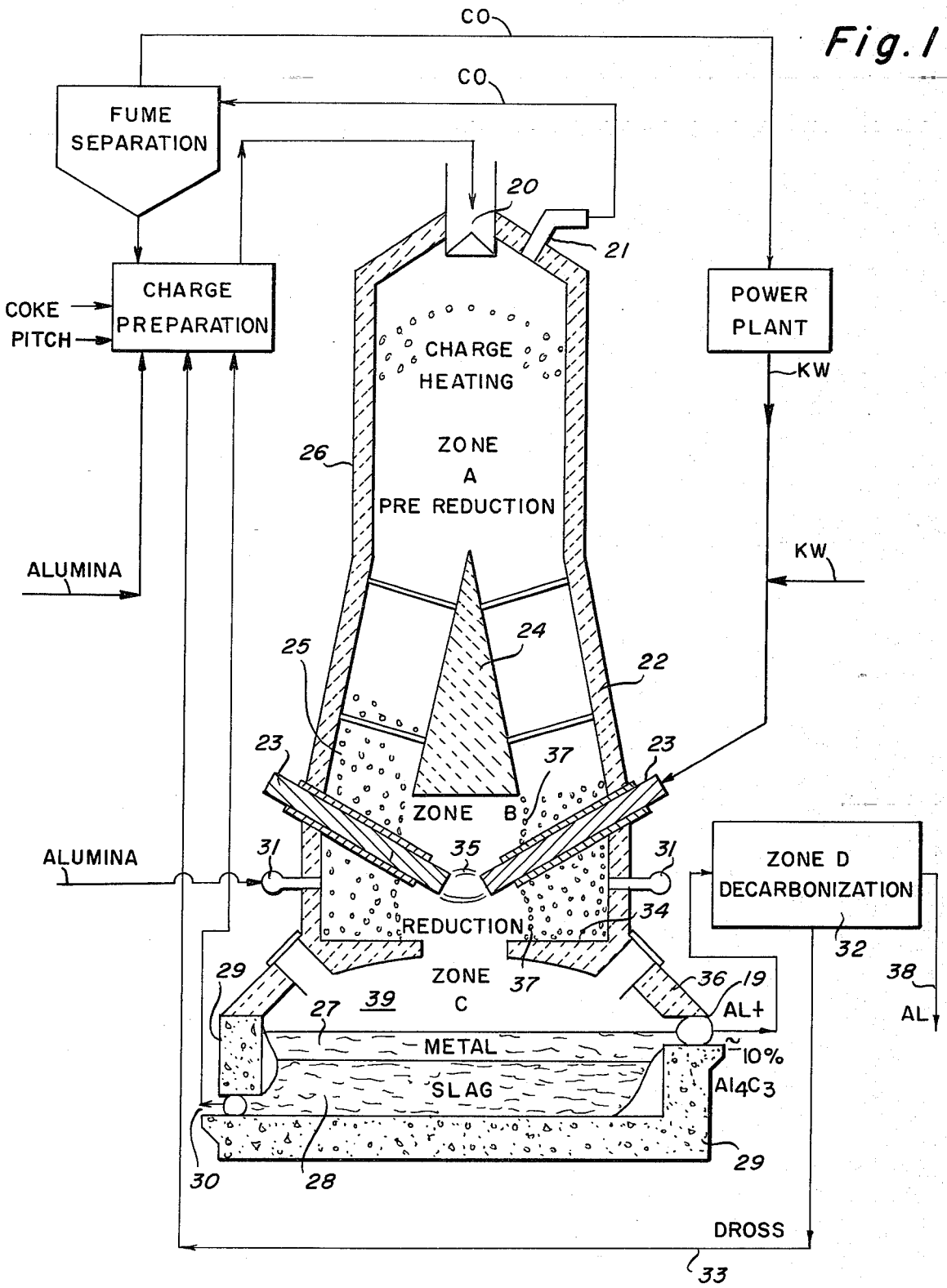
FIG. 1 is a sectional elevation of a moving-bed shaft carbothermal reduction furnace as a part of a schematically illustrated closed recycling system.

The system shown in FIG. 1 is directed to large reduction furnaces (50MW) having means to minimize the production of vaporization products in the reduction zone and combind with means to recover fuel values from the CO produced as a byproduct in the reductionn zone. Reduction furnace 26 is a moving-bed shaft furnace which is closed except for tapping ports 19 and 30, charge admission lock 20, and gas vent 21, so that it is operable under low positive pressure, as is known in the art. Furnace 26 is lined with carbon 22 and is provided with adjustable electrode means (not shown in the drawings) to cause electric arcs 35 to flow between two or more electrodes 23. Charge-shaping means 24 are also constructed of carbon for shaping the descending charge column 25. Insulation means are provided so that electrical conduction through the furnace walls is minimized. A product chamber 39 is provided to receive the metal produced on surface 37 and keep it isolated from reactive carbon. Chamber 39 is surrounded by an overhead roof supporting hearth shoulders 34, inclined roof 36, and furnace bottom 29 which is lined with non-carbonaceous refractories.

Ports 31 are provided for blowing powdered alumina into the reduction zone. Channels (not shown in the drawings) are also provided through the centers of the electrodes for additional introduction of alumina into the reduction zone.

While operating, furnace 26 comprises a pre-reduction zone A which is above and in surrounding relationship to charge-shaping means 24, a reduction zone B which surrounds arcs 35, and a product zone C at its bottom within chamber 39. A vapor/gas mixture is given off in zones B and C. Above zone A is a column of charge materials which is counter-currently heated by the escaping vapor/gas mixture when back reactions occur within the charge column. The residual gases from these back reactions leave furnace 26 through gas vent 21.

In zone A, downwardly moving charge column 25 is heated to pre-reduction temperatures before it splits around charge-shaping means 24. Charge column 25 then reaches the bottom edge of charge-shaping means 24 and flows toward and past the banks of electrodes 23 until it reaches hearth shoulders 34 of furnace 26, while simultaneously tending to flow inwardly toward the center of furnace 26. While so flowing, the temperature of charge column 25 increases because of radiation from arcs 35 between electrodes 23.

When reduction temperature is reached, an upstanding melt surface 37 is formed by melting of aluminum produced in the reduction reaction. The melt immediately flows downwardly to join a metal layer 27 which forms a pool within furnace bottom 29. Metal layer 27, containing aluminum carbide, rests either upon the hearth itself or preferably upon a slag layer 28 which represents an accumulation of slag that is produced whenever alumina in excess of stoichiometric requirements is charged to the furnace.

Alumina is introduced through ports 31 into reduction zone B of charge column 25 shortly before upstanding wall 37 is created. Alumina is also selectively introduced to the reduction zone through channels (not shown in the drawings) which run through the centers of electrodes 23.

Aluminum metal, containing approximately 10% $Al_4C_3$, flows from metal layer 27 through port 19 into apparatus 32 wherein is a decarbonization zone D in which purified aluminum metal and dross are produced and separated. Purified aluminum metal leaves apparatus 32 as stream 38, and dross leaves as stream 33 to enter a charge preparation apparatus to which alumina and slag (leaving slag layer 28 through port 30) are also fed. Coke, alumina, and other particles, produced in a fume separation zone, are additionally fed to the charge preparation apparatus. The charge, preferably as suitably shaped briquettes, moves through the supply line, enters admission lock 20, and thence falls upon the top of charge column 25. Residual gases, after the vapor/-gas mixture has passed countercurrently through charge column 25 for heating and reducing the alumina, leave furnace 26 through gas vent 21 as discharged gases, pass through the fume separation zone, and are sent to a power plant for burning and producing electricity which is then fed to electrodes 23. This process is consequently a closed cycle which minimizes the introduction of additional energy to the process.

Figure 2:
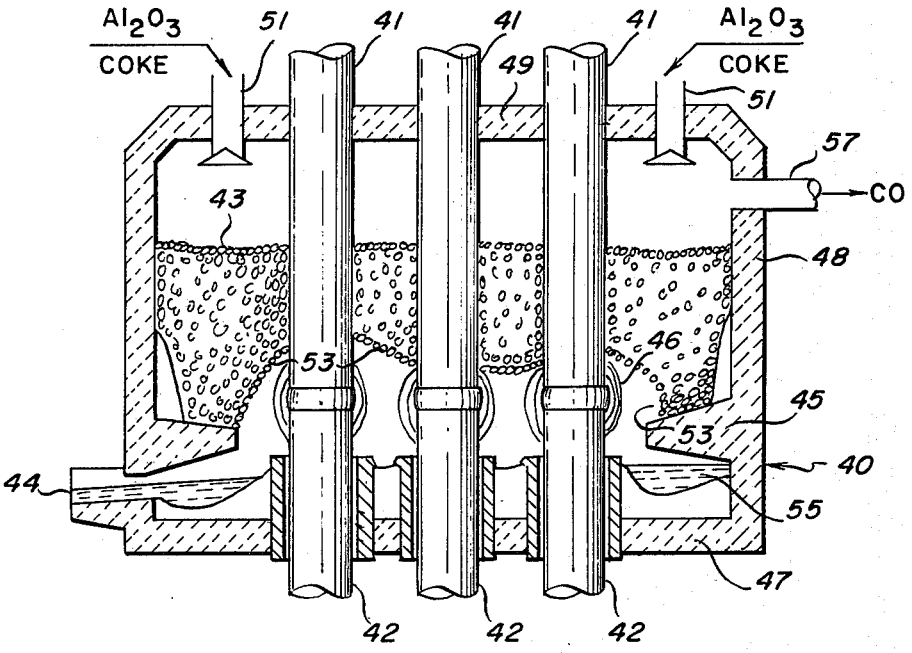
FIG. 2 is an enlarged sectional elevation of a similar furnace wherein a plurality of electrodes are vertically disposed and closely adjacent.

FIG. 2 shows another apparatus embodiment 40 for the practice of this invention. Apparatus 40 comprises a bottom 47, sides 48, and a top 49. Vertically disposed electrodes 41,42 meet within apparatus 40 and form arcs 46. Alumina and coke are fed as charge through admission locks 51 into the interior of apparatus 40. The charge falls onto bed 43 which moves downwardly, being supported on hearth shoulders 45. Heat from arcs 46, between electrodes 41,42, radiates to charge 43 and forms melt surfaces 53 which are above and to the sides of arcs 46. Aluminum metal is produced from the charge along melt surfaces 53 that are exposed to the heat radiated from arcs 46. This metal falls toward bottom 47 within the lower hearth and forms a metal pool 55 which is continually drained off through stream 44 to a decarbonizing furnace. Hearth shoulders 45 prevent contact of unreduced charge with pool 55. Byproduct CO, after passing countercurrently through bed 43, leaves through gas vent 57.

In this invention, the open arc between any two electrodes does not heat the charge by transfer of electrical current to the charge but heats by thermal radiation to the charge. The rate of heat flux to the surface of the charge that is visible to the sight of the arc is in the range of 10–100 KW/sq. inch. Under these conditions, melt surfaces 37,53 of the charge stabilize at the reduction temperature, i.e., about 2100° C., but because the liquid metal that is produced flows immediately away from the surface to a collection zone and flows mainly over metal to reach the collection zone, conditions for taking carbon or aluminum carbide into solution with the metal product are minimized. The practical effect is that product containing less than 20% $Al_4C_3$ (usually closer to 9–12% $Al_4C_3$) falls quickly by gravity to the collection zone, wherein it is isolated from the charge and from which it can be withdrawn.

Indirect arc heating, such as transferring heat by thermal radiation from arcs between electrodes, provides the means to employ high voltage-low current arcs and even multiphase AC arcs without overheating the surface of the charge being reduced, thus minimizing the production of vapors during reduction to produce aluminum. The quick removal of metal produced from the surface of a charge being reduced, by gravity flow downwardly therefrom and dropping off therefrom, minimizes the contact time with carbon sources such as semi-reduced reactants.

Alumina can be provided in excess of stoichiometric requirements. Such excess produces slag concurrently with the production of metal, and this slag will also run over the melt surface or fall from the melt surface to the lower chamber or lower hearth where, at a temperature about 1850° to 1950° C., it will rest as a separate layer under the metal layer. Periodically, the slag accumulation is tapped and recycled to the charge preparation step.

Vapors of Al and $Al_2O$, produced in the reduction step, mix with the CO that is also produced in this step and pass upwardly as the vapor/gas mixture through the charge column where these vapors and gas back react to produce $Al_2O_3$ and $Al_4C_3$ and compounds thereof, releasing heat which is used to drive prereduction reactions and form residual gases. Such back reactions are defined as:

(1) reactions between components of the aluminum-containing vapor and components of the charge, such as reactions between vaporized aluminum and carbon; and (2) reactions between two or more components of the vapor/gas mixtures, such as reactions between carbon monoxide and aluminum monoxide ($Al_2O$).

These back reactions release heat at temperatures sufficiently high as to cause pre-reduction reactions to occur between components of the charge column. Typical of such prereduction reactions is the reaction between alumina ($Al_2O_3$) and carbon to produce aluminum tetraoxycarbide ($Al_4O_4C$) and/or aluminum carbide ($Al_4C_3$).

However, it is necessary to control the liquid/solids ratio in the charge column above the hearth in order to provide a non-slumping charge which will retain the appropriate permeability for passage of vapors and gases and their access to charge particles, so that back reactions can occur to release heat for use in pre-reduction reactions. Broadly, these liquid/solid control methods involve selecting a ratio for the portion of stoichiometrically required alumina added with the charge and adding the remaining alumina satisfying this ratio to the reduction zone. Preferably, this added alumina is fed to the reduction zone through ports 31, as shown in FIG. 1, or through the electrodes 23.

As one charge embodiment, a charge is prepared by mixing petroleum coke with metallurgical alumina, recycled slag, recycled dross, and a petroleum or coal tar pitch. The charge is formed into briquettes and is baked to a temperature of 800° C., in order to drive off hydrocarbon volatiles, before addition to the furnace.

Some or even all of the alumina that is stoichiometrically required for reduction may be injected through ports 31. The ratio of alumina fed through lock 20 to alumina charged through ports 31 is determined by experience with the objective of developing that liquid/solids ratio in the pre-reduction products which facilitates flow of the charged briquettes down the shaft to the reduction zone without premature slumping, fusing, or sintering of the charge column.

Aluminum containing from 5 to 15% aluminum carbide forms on melt surface 37 to fall to a holding zone and create metallic layer 27. Any slag produced in the reduction zone falls into layer 27 to pass into the slag layer 28.

Aluminum containing from 5 to 15% $Al_4C_3$ (usually approximately 10%) is tapped for further treatment in decarbonizing zone D within apparatus 32. Accumulated slag is recycled to charge preparation.

Because it will be readily apparent to those skilled in the art that innumerable variations, modifications, applications, and extensions of the principles hereinbefore set forth can be made without departing from the spirit and scope of the invention, what is herein defined as such scope and is desired to be protected should be measured, and the invention should be limited, only by the following claims.

What is claimed is:

1. A method for carbothermic reduction of alumina to produce aluminum containing less that 20% $Al_4C_3$, comprising:

A. adding a composite charge to the top of a shaft furnace for forming a charge column as a downwardly moving bed therewithin;

B. countercurrently passing a vapor/gas mixture comprising aluminum-containing vapor and carbon monoxide through said charge column to produce back reactions within said charge column and to release heat to said charge;

C. producing an open arc between at least two opposed electrodes; and

D. forming a reduction zone within said charge column near the bottom thereof and producing a melt surface which is spaced from said arc in surrounding relationship thereto, said melt surface being stabilized at a reduction temperature of about 2100° C. by a rate of heat flux to said melt surface which is in the range of 10–100 KW/sq. inch.

2. The method of claim 1, wherein a lower hearth is provided beneath said arc and a metal layer is formed therewithin as a pool.

3. The method of claim 2, wherein said lower hearth is provided with a non-reactive lining.

4. The method of claim 3, wherein said non-reactive lining is non-carbonaceous.

5. The method of claim 2, wherein a slag layer is formed beneath said metal layer.

6. The method of claim 5, wherein said slag layer is produced as an accumulation of slag when alumina in excess of stoichiometric requirements is charged to said reduction zone.

7. The method of claim 5, wherein aluminum metal is withdrawn from said metal layer and slag is separately withdrawn from said slag layer.

8. The method of claim 7, wherein said slag is recycled to form said composite charge.

9. The method of claim 2 or 4, wherein said aluminum metal enters a decarbonization zone in which purified aluminum metal and dross are produced and separated.

10. The method of claim 9, wherein said dross is additionally recycled to form said composite charge.

11. The method of claim 10, wherein components of said vapor/gas mixture back react within said charge column, as defined in Step B of claim 1, to produce residual gases which are discharged from said shaft furnace and are fed to a fume separation zone.

12. The method of claim 11, wherein particles are separated from said discharged gases within said fume separation zone and are additionally recycled to form said composite charge.

13. The method of claim 12, wherein said discharged gases pass from said fume separation zone and are burned in a power plant which produces electricity for feeding to said at least two opposed electrodes.

14. The method of claim 1, wherein said back reactions release said heat at temperatures sufficiently high as to cause pre-reduction reactions to occur between components of said charge column.

15. The method of claim 14, wherein said pre-reduction reactions comprise the reaction between alumina and carbon to produce aluminum tetraoxycarbide and/or aluminum carbide.

16. A method for carbothermic production of an aluminum product while supplying AC power economically through at least a pair of electrodes at high voltage and low currents to produce an open arc between said electrodes, while minimizing excessive production of vaporized aluminum because of said open arcs, and while minimizing formation of aluminum carbide in said aluminum product, said method comprising the following steps:

A. providing a moving-bed shaft furnace which is operable under pressure and contains:

(1) said pair of electrodes which are connected to a high-voltage, low-current source of AC power, (2) a hearth means for separating a descending charge from said aluminum product, (3) a collection zone for said aluminum product, and (4) a charge-shaping means for cooperatively interacting with said hearth means to suspend said descending charge as a charge column and force said charge to move toward said open arc; and B. continuously operating said furnace, without relying on intermittent arc application to said charge, without relying on contact of said aluminum product with an aluminarich slag, and under conditions wherein vapor production is limited to the amount that is characteristic of equilibrium vapor conditions, by supplying AC power to said electrodes to form said open arc, whereby:

(1) an upstanding melt surface is created within said charge and near the bottom of said charge column, said surface being spaced from and surrounding said open arc and being heated by radiation from said open arc at a rate of heat flux in the range of 10–100 KW/sq. inch, (2) stable reduction temperatures of about 2100° C. are created on said surface, and (3) said aluminum product is produced on said surface as a liquid which flows immediately away, over, and from said surface and over metal to reach said collection zone under conditions that minimize adsorption of carbon or aluminum carbide formation.

17. The method of claim 16, wherein said product collection zone is a receiving chamber which is lined with non-carbonaceous material.

18. The method of claim 17, wherein said hearth means is a hearth shoulder which is disposed above said receiving chamber and below said electrodes to define an opening beneath said charge-shaping means.

19. The method of claim 18, wherein said aluminum product contains 9–12% aluminum carbide.

20. A continuous carbothermic reduction process wherein vapor production is minimized, AC current is used, control is simplified, and aluminum metal product is quickly removed from contact with reactive carbon, said process comprising the following steps:

A. providing a moving-bed shaft furnace which:

(1) is operable under pressure, (2) contains a hearth shoulder forming a centrally disposed opening, (3) contains a charge shaping means which is disposed in the center of said furnace and cooperatively interacts with said hearth shoulder for supporting a descending charge column and for forcing said charge to flow inwardly toward said opening which is beneath said charge-shaping means, (4) comprises a pair of opposed electrodes which are disposed at approximately the bottom of said charge column, the opposed ends of said electrodes being approximately above said opening and beneath said charge-shaping means, and (5) contains a product zone disposed beneath said opening, whereby product within said product zone is separated from said charge column;

B. adding a composite charge to the top of said shaft furnace for forming said charge column;

C. countercurrently passing a vapor/gas mixture comprising aluminum-containing vapor and carbon monoxide through said charge column to produce back reactions within said charge column and to release heat to said charge;

D. producing an open arc between said pair of electrodes to liberate heat radiating from said arc and create an upstanding melt surface above and to the sides of said open arc and at the bottom of said charge column while forming said vapor/gas mixture; and E. creating stable reduction temperatures of about 2100° C. on said melt surface and producing liquid aluminum which flows immediately away, over, and from said melt surface to reach said product zone under conditions that minimize adsorption of carbon from said charge column and aluminum carbide formation.

* * * * *